US006091204A

United States Patent [19]

Chen

[11] Patent Number: 6,091,204

[45] Date of Patent: Jul. 18, 2000

[54] CONTROL CIRCUIT FOR CONTROLLING DECORATIVE LIGHT STRING

[76] Inventor: Johnny Chen, No.2, Alley 2, Lane 626, Chung Chen Ld., Hsinchu City, Taiwan

[21] Appl. No.: 09/199,801

[22] Filed: Nov. 25, 1998

[51] Int. Cl.[7] ..... H05B 37/00

[52] U.S. Cl. ..... 315/185 R; 315/185 S; 315/323

[58] Field of Search ..... 315/185 R, 185 S, 315/193, 184, 178, 179, 180, 323

[56] References Cited

U.S. PATENT DOCUMENTS 5,854,541 12/1998 Chou ..... 315/185 R

*Primary Examiner*—David Vu

*Attorney, Agent, or Firm*—Dougherty & Troxell

[57] ABSTRACT

A control circuit for controlling a decorative light string by using a number of three-wire flashing control lamps is disclosed. In the circuit, a common contact of latter switching type three-wire flashing control lamp is connected to a normal open contact of former three-wire flashing control lamp. A normal closed contact of each three-wire flashing control lamps is connected with a light string including a plurality of regular lamps electrically connected in series. A two-wire flashing control lamp is further connected between the normal open contact of one of the switching type three-wire flashing control lamp and the light string connected thereto.

3 Claims, 6 Drawing Sheets

CONTROL CIRCUIT FOR CONTROLLING DECORATIVE LIGHT STRING

BACKGROUND OF THE INVENTION

1. Field of the Invention

The present invention relates to a control circuit for a Christmas light string, and more particularly to a control circuit for controlling the flashing operation of a decorative light string by using three-wire flashing control lamps.

2. Description of the Prior Art

The prior art Christmas light string is formed by a two-wire flashing control lamp 10 electrically connected with a series of regular lamps 11, and an electric plug 2, as shown in FIG. 1. An electric power source is supplied to the Christmas light string via the electric plug 2 and a pair of power lines.

Typically, the prior art two-wire flashing control lamp 10 includes a bimetal plate, a filament, and two conductive poles therein. The conductive poles are connected with exterior conductive wires for facilitating electrical connection to form a decorative light string. The illumination of the light string may be controlled by means of the heating state of the bimetal plate installed in the flashing control lamp.

However, the light string controlled by the prior art flashing control lamp can only create a monotonous flashing effect without various flickering patterns. Even a number of light strings may be electrically connected in parallel. In order to enhance the visible flashing effect of the prior art light string, a known electrical controller by using sequential control technique is widely employed. However, the cost of the controller is rather high.

Accordingly, the primary object of the present invention is to provide an improved control circuit for a decorative light string. The decorative light string of the present invention is provided with at least one three-wire flashing control lamp arranged in the light string, so that versatile flashing effects may be easily achieved. Especially, a number of light strings employing the circuit arrangement of the present invention may be further connected in parallel to present a more versatile sequentially controlling effect.

The other object of the present invention is to provide an improved decorative light string with a simple control circuit arrangement by using three-wire flashing control lamps, without need of electrical controller.

The present invention will be better understood and its numerous objects and advantages will become apparent to those skilled in the art by referencing to the following drawings in which:

DETAILED DESCRIPTION OF THE PREFERRED EMBODIMENT

Figure 1:
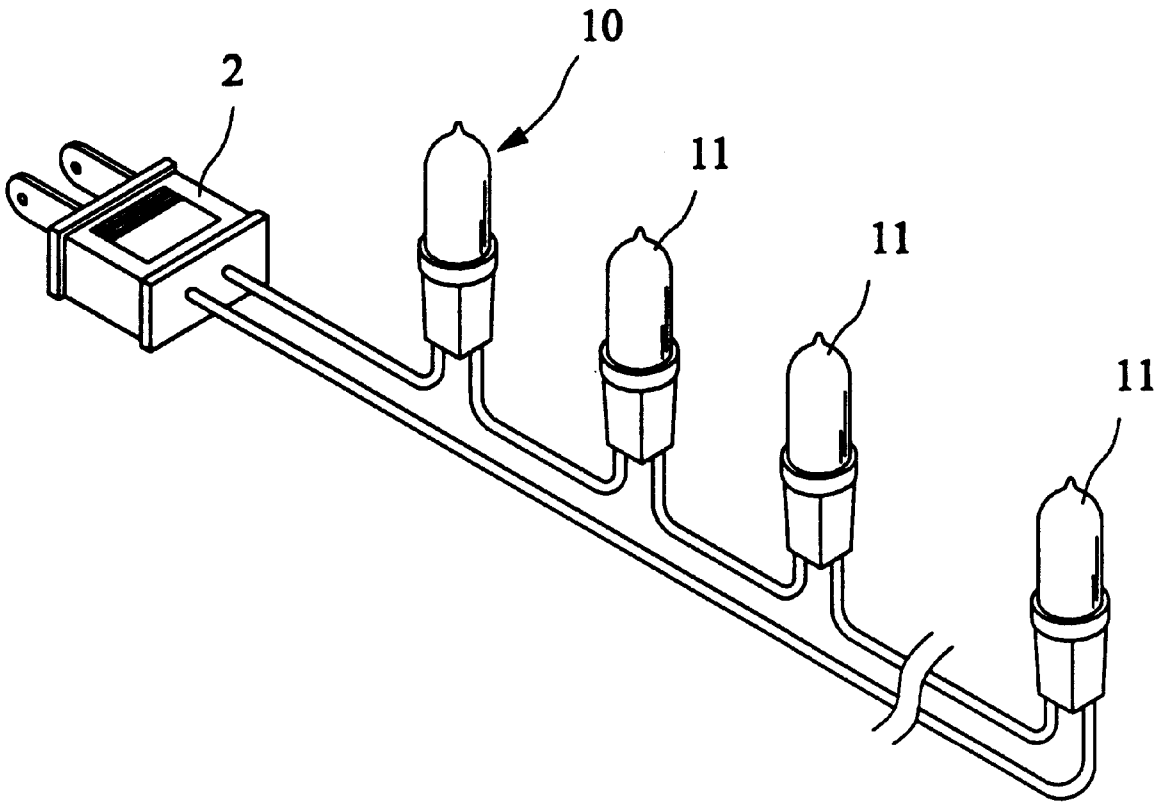
FIG.1(PRIOR ART)
FIG. 1 is a schematic perspective view of a prior art Christmas light string.
Figure 2:
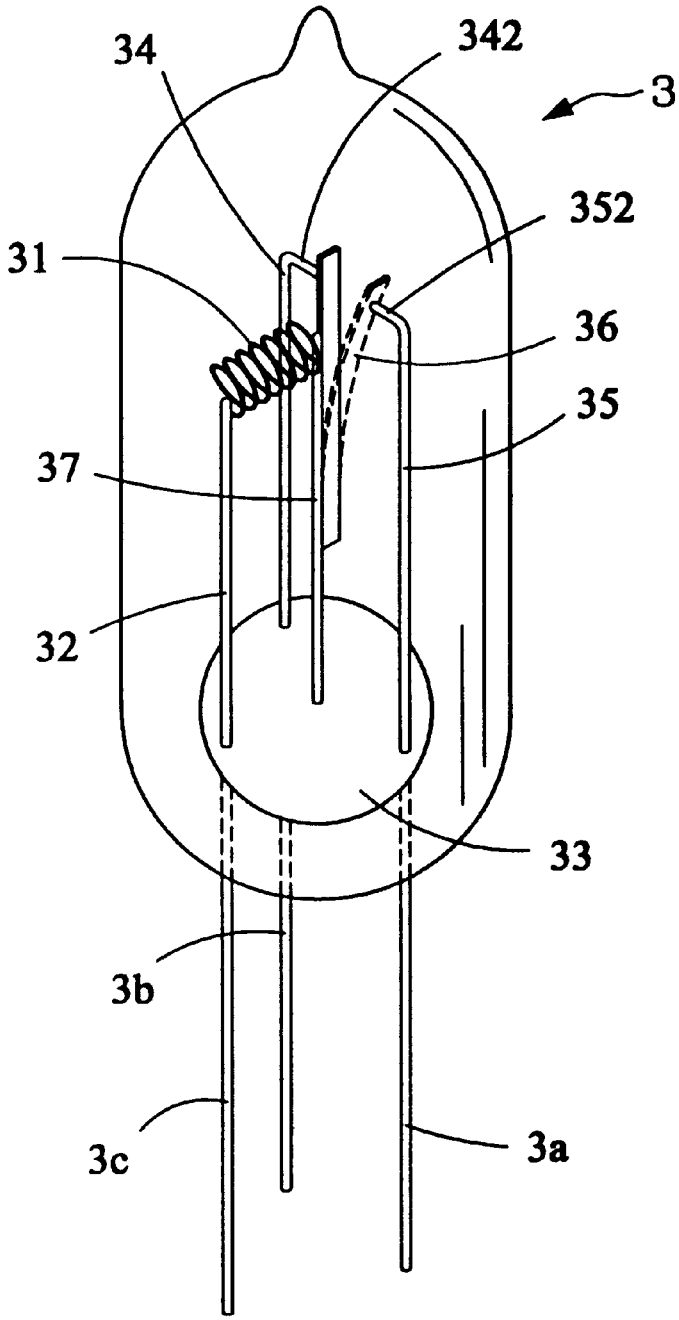
FIG. 2 is a perspective view showing a switching type three-wire flashing control lamp used in the present invention.

With reference to FIG. 2, a switching type three-wire flashing control lamp used in the present invention is shown. The flashing control lamp 3 includes a first, a second and a third conductive poles 32, 34, 35, a filament 31, a central pole 37, and a bimetal plate 36. One end of the filament 31 is connected with the first conductive pole 32, and the other end of the filament 31 is connected with the central pole 37. The central pole 37 is further attached with a bimetal plate 36 by welding, while one end of the bimetal plate 36 will become a free end.

The first, second and third conductive poles 32, 34, 35 and central pole 37 are positioned by a glass positioning ball 33 in the control lamp 3. Then, the first conductive pole 32, the second conductive pole 34, and the third conductive pole 35 extend to form a common contact 3*c*, a normal closed contact 3*b*, and a normal open contact 3*a* respectively.

When an external electric power source is not supplied to the common contact 3*c* and the normal closed contact 3*b*, the bimetal plate 36 contacts the second conductive pole 34. When an external electric power source is supplied to the common contact 3*c* and the normal closed contact 3*b*, the flashing control lamp 3 will light and generate heat within the lamp. When a predetermined time has elapsed, the bimetal plate 36 will bend by heating, separate from the second conductive pole 34, and then contact with the third conductive pole 35.

Figure 3:
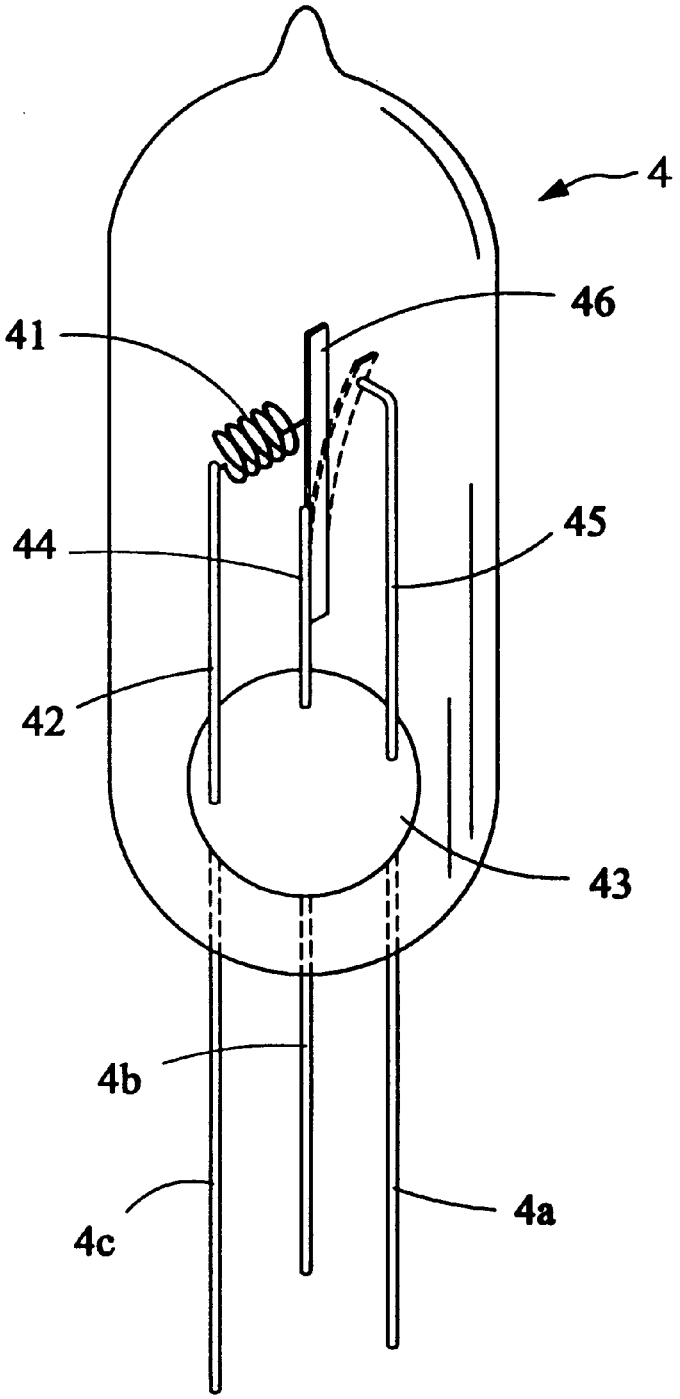
FIG. 3 is a perspective view showing a holding type three-wire flashing control lamp used in the present invention.

FIG. 3 is a perspective view showing a holding type three-wire flashing control lamp used in the present invention. Most of the structure of this embodiment is identical to that of the first embodiment shown in FIG. 2, except that in the three-wire flashing control lamp 4, instead of being installed with a central pole, only a first conductive pole 42, a second conductive pole 44, and a third conductive pole 45 are installed in the lamp. In addition, the bimetal plate 46 is welded directly on the second conductive pole 44. The filament is connected between the first conductive pole 42 and the second conductive pole 44.

The first, second and third conductive poles 42, 44, and 45 are positioned by a glass positioning ball 43 in the control lamp 4. Then, the first conductive pole 42, the second conductive pole 44, and the third conductive pole 45 extend to form a common contact 4*c*, a normal closed contact 4*b*, and a normal open contact 4*a* respectively.

In operation, when the first conductive pole 42 and the second conductive pole 44 are supplied with an electric power source, heat is generated within the flashing control lamp 4. After a predetermined time has been elapsed, the bimetal plates 46 will bent by heating to contact with the third conductive pole 45. At this time, the second conductive pole 44 still electrically connects with the first conductive pole 42.

Various embodiments of the present invention by using the switching type three-wire flashing control lamp shown in FIG. 2 or the holding type three-wire flashing control lamp shown in FIG. 3 are described in detail as follows:

1. First Embodiment

Figure 4:
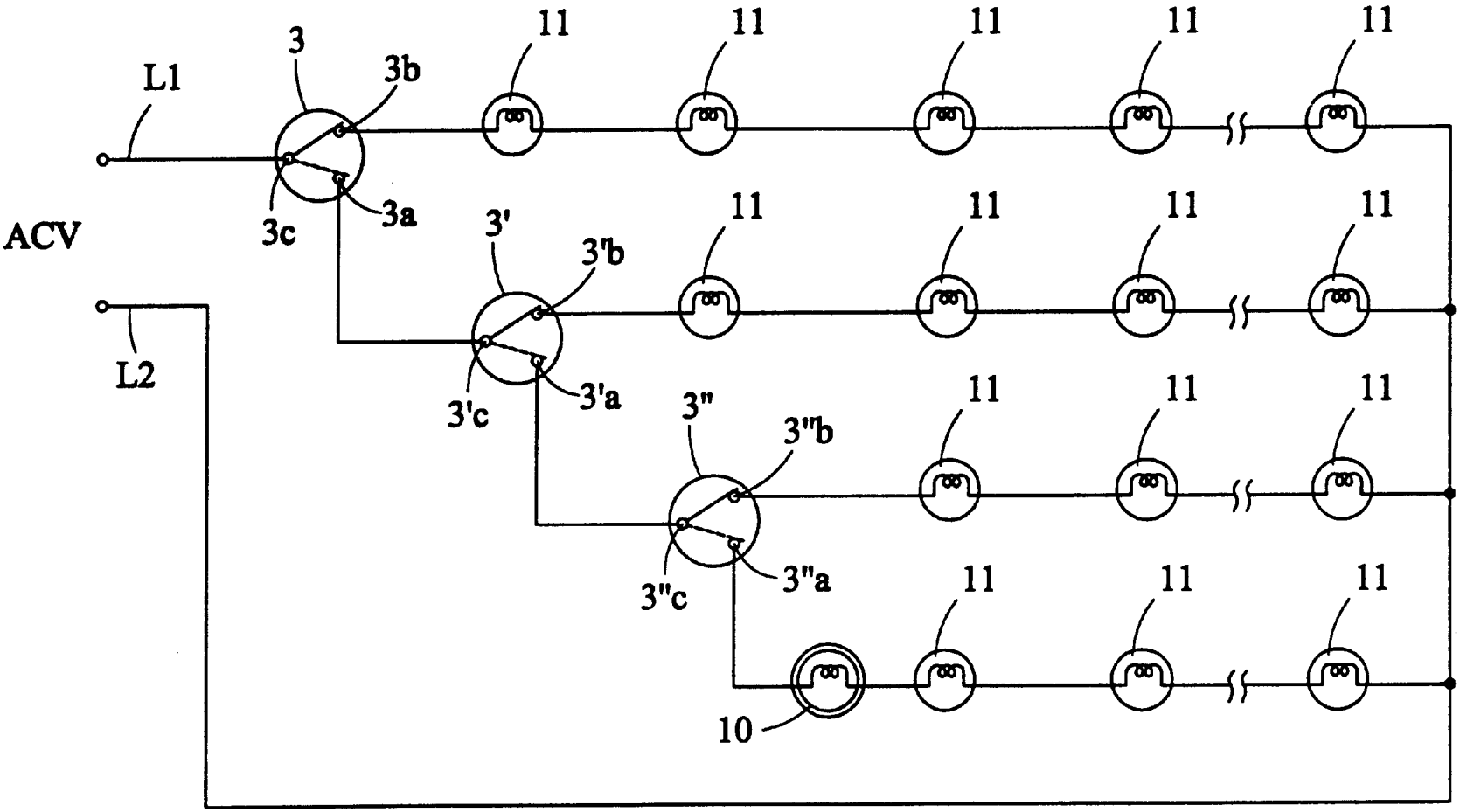
FIG. 4 is a schematic circuit diagram of the decorative light string in accordance with a first embodiment of the present invention.

FIG. 4 is a schematic circuit diagram of the decorative light string in accordance with the first embodiment of the present invention. In this embodiment, it includes for example four light strings. The first light string includes a switching type three-wire flashing control lamp 3 shown in FIG. 2 and a number of regular lamps 11. The second light string includes a switching type three-wire flashing control lamp 3' and a number of regular lamps 11. The third light string includes a switching type three-wire flashing control lamp 3" and a number of regular lamps 11. The fourth light string includes a prior art two-wire flashing control lamp 10 and a number of regular lamps 11.

It is noted that one end of the latter light string is connected to a normal open contact of the former light string. For example, the common contact 3'*c* of the second light string is connected to a normal open contact 3*a* of the three-wire flashing control lamp 3 in the first light string.

The circuit operation of this embodiment is described as follows:

a. when an alternating current power source ACV is supplied to power lines L1 and L2, the normal closed contract 3*b* of the three-wire flashing control lamp 3 initially contacts with the common contact 3*c* thereof, so that all regular lamps 11 serially connected in the first light string are all lighted.

b. After the first light string is lighted for a predetermined time period, the common contact 3*c* of the three-wire flashing control lamp 3 in the first light string switches to the normal open contact 3*a* from the normal closed contact 3*b*. At this time, the power source ACV is supplied to the second light string via the common contact 3'*c* and the normal closed contact 3'*b* of the three-wire flashing control lamp 3' in the second light string. So, all regular lamps serially connected in the second light string are lighted, while all regular lamps in the first light string are turned off.

c. After the second light string is lighted for a predetermined time period, the common contact 3'*c* of the three-wire flashing control lamp 3' in the second light string switches to a normal open contact 3'*a* from the normal closed contact 3'*b*. So, all regular lamps serially connected in the third light string are lighted, while all regular lamps in the second light string are turned off.

d. After the third light string is lighted for a predetermined time period, the common contact 3"*c* of the three-wire flashing control lamp 3" in the third light string switches to a normal open contact 3"*a* from the normal closed contact 3"*b*. So, all regular lamps serially connected in the fourth light string are lighted, while all regular lamps in the third second light string are turned off.

e. After the fourth light string is lighted for a predetermined time period, the two-wire flashing control lamp 10 serially connected in the fourth light string switches from closed state to open state. So, all regular lamps serially connected in the fourth light string are turned off. At this time, all regular lamps arranged in each light string are turned off.

f. After a predetermined time period is reached, the three-wire flashing control lamp 3 in the first light string, the common contact 3*c* of the three-wire flashing control lamp 3 will be connected to the normal closed contact 3*b* thereof again, so that all regular lamp in the first light string are lighted. Thereafter, the flashing operation of the circuit repeats actions from step a to step f described above.

In such manner, the light strings in the circuit are lighted sequentially. In practice, the numbers of the light strings may be changed if desired.

2. Second Embodiment

Figure 5:
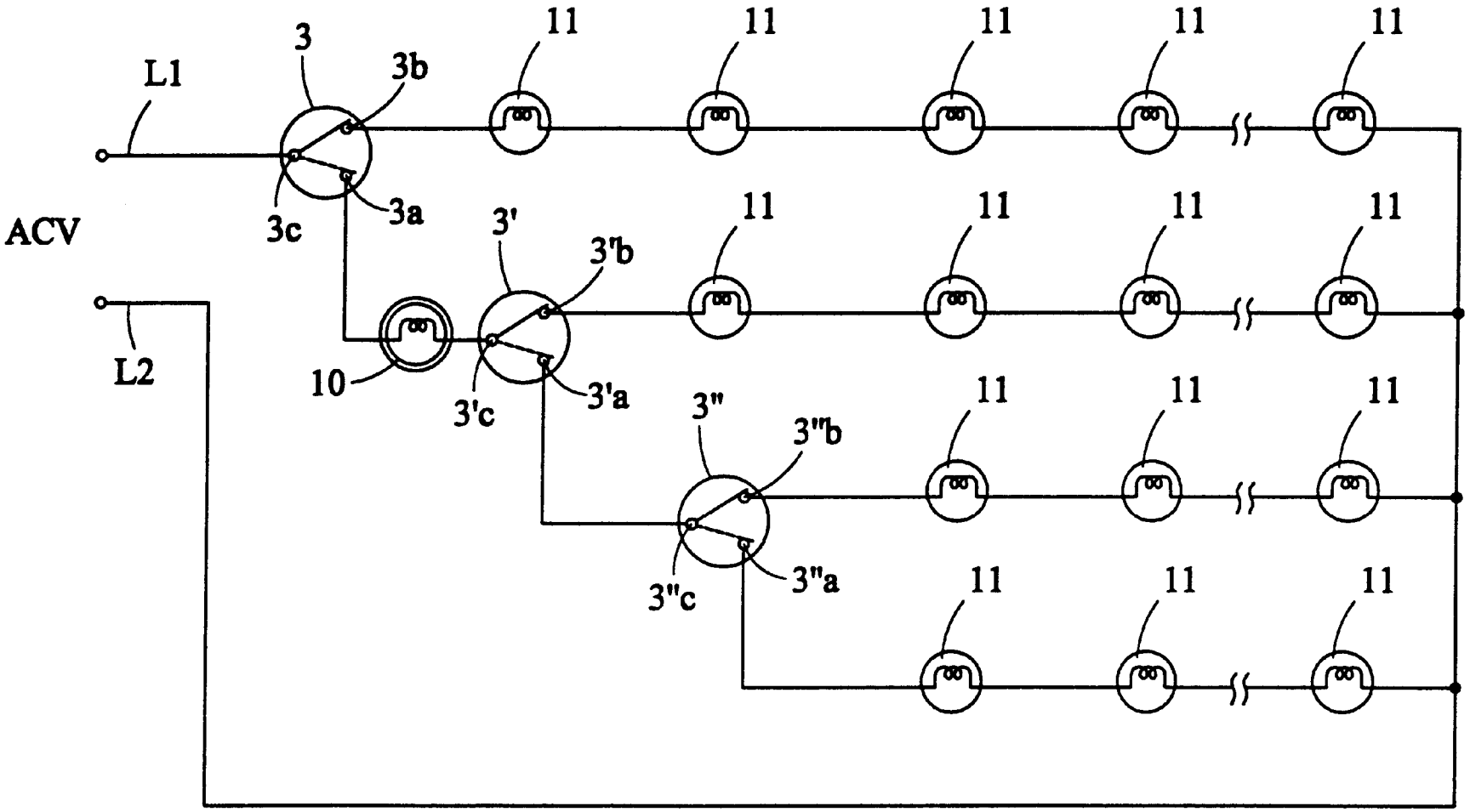
FIG. 5 is a schematic circuit diagram of the decorative light string in accordance with a second embodiment of the present invention.

It is noted that the two-wire flashing control lamp 10 is electrically connected with the regular lamps of the fourth light string. Alternatively, the two-wire flashing control lamp 10 may be connected with the other light string in series. For example, the two-wire flashing control lamp 10 is connected between the common contact 3'*c* of the three-wire flashing control lamp 3' and the normal open contact 3*a* of the three-wire flashing control lamp 3 of the first light string, as shown in FIG. 5.

3. Third Embodiment

Figure 6:
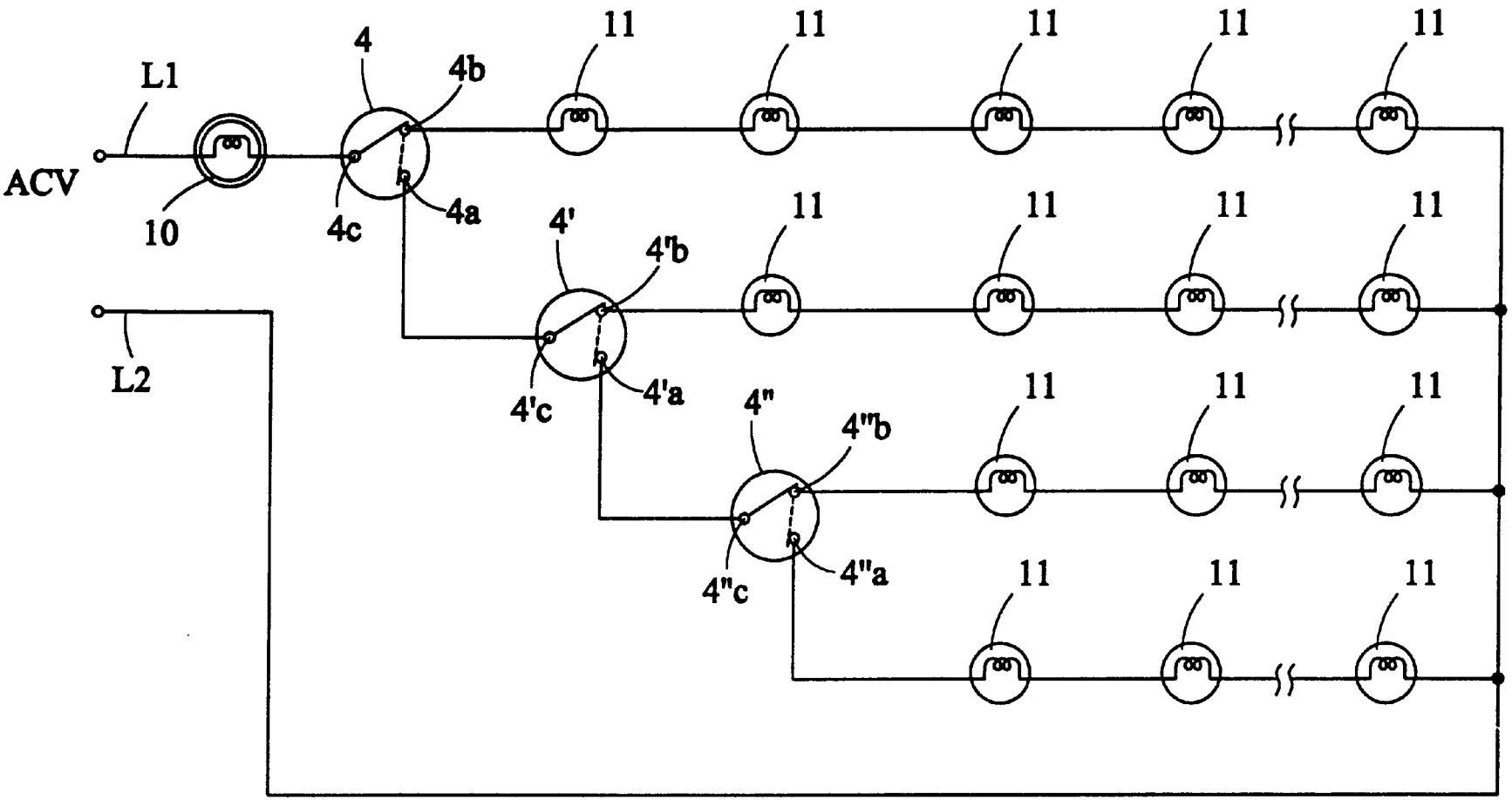
FIG. 6 is a schematic circuit diagram of the decorative light string in accordance with a third embodiment of the present invention.

FIG. 6 is a schematic circuit diagram of the decorative light string in accordance with the third embodiment of the present invention. In this embodiment, it also includes four light strings. The first light string includes a holding type three-wire flashing control lamp 4 shown in FIG. 3 and a number of regular lamps 11. The second light string includes a holding type three-wire flashing control lamp 4' and a number of regular lamps 11. The third light string includes a holding type three-wire flashing control lamp 4" and a number of regular lamps 11. The fourth light string includes a number of regular lamps 11.

It is noted that one end of the latter light string is connected to a normal open contact of the former light string. For example, the common contact 4'*c* of the second light string 4' is connected to a normal open contact 4*a* of the three-wire flashing control lamp 4 in the first light string. Further, a prior art two-wire flashing control lamp 10 is connected between the common contact 4*c* of the holding type three-wire flashing control lamp 4 of the first light string and a power line L1.

The circuit operation of this embodiment is described as follows:

a. when an alternating current power source ACV is supplied to power lines L1 and L2, the normal closed contract 4*b* of the three-wire flashing control lamp 4 initially contacts with the common contact 4*c* thereof, so that all regular lamps 11 serially connected in the first light string are all lighted.

b. After the first light string is lighted for a predetermined time period, the normal open contact 4*a* of the three-wire flashing control lamp 4 in the first light string is also connected to the normal closed contact 4*b*. At this time, the power source ACV is supplied to both the first light string and the second light string. So, all regular lamps arranged in the first light string and the second light string are lighted.

c. After the second light string is lighted for a predetermined time period, the normal open contact 4'*a* of the three-wire flashing control lamp 4 in the second light string is also connected to the normal closed contact 4'*b*. At this time, all regular lamps arranged in the first light string, the second light string, and the third light string are all lighted.

d. After the third light string is lighted for a predetermined time period, the normal open contact 4"*a* of the three-wire flashing control lamp 4 in the third light string is also connected to the normal closed contact 4"*b*. At this time, all regular lamps arranged in the first light string, the second light string, the third light string, and the forth light string are all lighted.

e. After the forth light string is lighted for a predetermined time period, the two-wire flashing control lamp 10 changes its state from closed state to open state, so as to turn off all regular lamps of the first, second, third, and forth light string.

f. After a predetermined time period is reached, the two-wire flashing control lamp 10 changes its state from open state to closed state, so that the power source ACV is supplied to the circuit again. Thereafter, the flashing operation of the circuit repeats actions from step a to step f described above.

In conclusion, the control circuit of the present invention is capable of controlling the flashing operation of a decorative light sting set by employing a known two-wire flashing control lamp and a number of switching type and/or holding type three-wire flashing control lamps.

Although the preferred embodiments of the present invention have been described to illustrate the present invention, it is apparent that changes and modifications in the specifically described embodiments can be carried out without departing from the scope of the invention which is intended to be limited only by the appended claims.

What is claimed is:

1. A control circuit for controlling a decorative light string, comprising:

a plurality of switching type three-wire flashing control lamps, each of which being provided with a common contact, a normal closed contact, and a normal open contact, the common contact of a first switching type three-wire flashing control lamp being connected to a first power line, and the common contact of a second switching type three-wire flashing control lamp being connected to the normal open contact of the first switching type three-wire flashing control lamp; and a plurality of light strings, each of which comprising a plurality of lamps electrically connected in series, one end of each light string being connected to a second power line and the other end of the light string being connected to the normal closed contact of a switching type three-wire flashing control lamp.

2. The control circuit for controlling a decorative light string as claimed in claim 1, further comprising a two-wire flashing control lamp electrically connected between the normal open contact of one of the plurality of switching type three-wire flashing control lamps and the light string connected thereto.

3. A control circuit for controlling a decorative light string, comprising:

a two-wire flashing control lamp;

a plurality of holding type three-wire flashing control lamps, each of which being provided with a common contact, a normal closed contact, and a normal open contact, the common contact of a first holding type three-wire flashing control lamp being connected to a first power line via the two-wire flashing control lamp, and the common contact of a second holding type three-wire flashing control lamp being connected to the normal open contact of the first holding type three-wire flashing control lamp; and a plurality of light strings, each of which comprising a plurality of lamps electrically connected in series, one end of each light string being connected to a second power line and the other end of the light string being connected to the normal closed contact of a holding type three-wire flashing control lamp.

* * * * *